US009456283B2

(12) United States Patent
Chiang et al.

(10) Patent No.: US 9,456,283 B2
(45) Date of Patent: Sep. 27, 2016

(54) ELECTROSTATIC ELECTROACOUSTIC TRANSDUCER AND FABRICATING METHODS FOR THE SAME

(71) Applicant: 3-O Lab Co. Ltd., Hsinchu (TW)

(72) Inventors: Dar-Ming Chiang, Hsinchu (TW); Jen-Luan Chen, Taipei (TW); E-Hung Lu, Taoyuan (TW)

(73) Assignee: 3-O LAB CO. LTD., Hsinchu (TW)

( * ) Notice: Subject to any disclaimer, the term of this patent is extended or adjusted under 35 U.S.C. 154(b) by 0 days.

(21) Appl. No.: 14/085,620

(22) Filed: Nov. 20, 2013

(65) Prior Publication Data

US 2015/0071468 A1 Mar. 12, 2015

(30) Foreign Application Priority Data

Sep. 12, 2013 (TW) ..... 102132914 A

(51) Int. Cl.

| | |
|---|---|
| ***H04R 25/00*** | (2006.01) |
| ***H04R 19/00*** | (2006.01) |
| *H04R 19/01* | (2006.01) |
| *H04R 19/02* | (2006.01) |

(52) U.S. Cl.

CPC ..... *H04R 19/005* (2013.01); *H04R 19/00* (2013.01); *H04R 19/01* (2013.01); *H04R 19/02* (2013.01); *H04R 2217/00* (2013.01); *H04R 2217/01* (2013.01); *H04R 2217/03* (2013.01)

(58) Field of Classification Search

CPC ..... H04R 19/02; H04R 19/00; H04R 19/01; H04R 19/0025; H04R 2217/00; H04R 2217/01; H04R 2217/03

USPC ..... 381/191, 190

See application file for complete search history.

(56) References Cited

U.S. PATENT DOCUMENTS

| | | | | |
|---|---|---|---|---|
| 4,286,122 | A * | 8/1981 | Iding | 381/163 |
| 6,791,519 | B2 * | 9/2004 | Aarts et al. | 345/87 |
| 2002/0135272 | A1 * | 9/2002 | Toda | 310/334 |
| 2009/0016551 | A1 * | 1/2009 | Chiang et al. | 381/191 |
| 2010/0027818 | A1 * | 2/2010 | Lee | H04R 19/013 381/191 |
| 2010/0104116 | A1 * | 4/2010 | Liou | H04R 19/013 381/191 |
| 2011/0255721 | A1 * | 10/2011 | Chen et al. | 381/191 |
| 2013/0010988 | A1 * | 1/2013 | Miller, III | H04R 19/016 381/151 |

* cited by examiner

*Primary Examiner* — Duc Nguyen
*Assistant Examiner* — Sean H Nguyen
(74) *Attorney, Agent, or Firm* — Muncy, Geissler, Olds & Lowe, P.C.

(57) ABSTRACT

An electrostatic electroacoustic transducer includes a first structure, a second structure and a third electrode. The third electrode is located between the first structure and the second structure. The first structure includes a first driving element, a first spacer and a first diaphragm, and the second structure includes a second driving element, a second spacer and a second diaphragm. By providing an alternating voltage source, a transformer and a bias voltage, the electrostatic electroacoustic transducer with a dual-diaphragm structure has a high efficiency and an enlarged range of audio frequency.

10 Claims, 9 Drawing Sheets

ELECTROSTATIC ELECTROACOUSTIC TRANSDUCER AND FABRICATING METHODS FOR THE SAME

BACKGROUND OF THE INVENTION

1. Technical Field

The present invention relates to an electrostatic electroacoustic transducer, and in particular to an electrostatic electroacoustic transducer having an electroacoustic transducing structure of small size, low cost and high efficiency.

2. Description of the Prior Art

An electroacoustic transducer is a type of electroacoustic converters which converts electrical energy into acoustic energy through physical effects. Typically, frequencies of acoustic waves that can be heard by human ears ranges from 20 Hz to 20000 Hz. Accordingly, electroacoustic transducers, such as speakers, are typically set to perform processing within such range.

Electroacoustic transducers can be classified by various manners, such as working principles, ways of radiating, diaphragm shapes, etc. By working principles, electroacoustic transducers can be classified into, for example, electromagnetic, piezoelectric, and electrostatic electroacoustic transducers.

Currently, electromagnetic electroacoustic transducers are the most widely-used, mature and market-dominating technologies. However, electromagnetic electroacoustic transducers are difficult to be flattened due to their inherent disadvantages. This makes electromagnetic electroacoustic transducers unable to follow the tendency of product miniaturization and flattening, to meet requirements and to keep a distortion below 2-3%. Therefore, electromagnetic electroacoustic transducers have been unable to catch up with the development of speaker technologies. Piezoelectric electroacoustic transducers employs the principle that piezoelectric materials deforms when affected by an electrical field, wherein a piezoelectrically driven device is placed in an electrical field formed from audio current signals and made to displace, thereby creating a reverse voltage effect for driving the diaphragm to produce sound. Although such electroacoustic transducers are structurally flattened and miniaturized, they cannot be bent since sintering needs to be performed to the piezoelectric materials, and they have larger distortion and are more unstable than electrostatic electroacoustic transducers. Compared to electromagnetic electroacoustic transducers, electrostatic electroacoustic transducers are characterized by less distortion, simpler structure, lighter diaphragms, better resolution, and ability of capturing very slight variations in music signals. Therefore, electrostatic electroacoustic transducers are of wider applicable range and greater developing potential.

Electrostatic electroacoustic transducers employ the principle of capacitor, where a conductive diaphragm and a fixed electrode are configured to have opposite polarities so as to form a capacitor. When sound source electrical signals are applied to the two poles of such capacitor, an attraction force is produced due to the variation of the electrical field magnitude, thereby driving the diaphragm to produce sounds. Such electrostatic electroacoustic transducers is currently at the leading position, however, the insufficient efficiency thereof needs to be addressed with diaphragms of large area or application of a high audio voltage, which creates issues of electric arc, high cost and large volume. In addition, the defect of insufficient bandwidth is also one of the problems to solve.

Conventional electrostatic speakers employ one layer of diaphragm, which leads to a limited bandwidth, so it is necessary to combine multiple speakers for improvement. Besides, in order to increase efficiency, in addition to an increase in area, the driving voltage is also increased for enabling the electrical field magnitude to reach 3 kV/mm or greater, which increases the danger in using such speakers.

SUMMARY OF THE INVENTION

In view of the problems above, the present invention provides an electrostatic electroacoustic transducer, comprising a first structure, a second structure and a third electrode, wherein the third electrode is located between the first structure and the second structure. The first structure includes a first driving element, a first spacer and a first diaphragm, and the second structure includes a second driving element, a second spacer and a second diaphragm. By providing an alternating voltage source, a transformer and a bias voltage, the electrostatic electroacoustic transducer with a dual-diaphragm structure has a significantly elevated efficiency. This cures the past drawback that high efficiency only comes with a large area, and enables thinning of the structure of such electrostatic electroacoustic transducer. Additionally, by employing the design of different strengths and tensions of the two diaphragms, the frequency range of audio response may be raised, so that the conventional defect of insufficient bandwidth can be addressed.

The first and second driving elements are porous conductive materials which have a plurality of first holes and a plurality of second holes, respectively, serving as sound channels for the first diaphragm and second diaphragm producing vibrational motions, such that the sounds can be transmitted outwards. Hole sizes and percentage of open area may indirectly affect the transmission of sound. The first and second spacers serve to support and separate the driving elements and the diaphragms, so as to prevent the electrostatic electroacoustic transducer from being silent due to the electrostatic contact between the driving elements and the diaphragms. Further, the first and second spacers are provided with a plurality of first intervals and a plurality of second intervals, respectively, functioning as regions for the first and second diaphragms producing vibrational motions. The first diaphragm is provided with the first dielectric and the first electrode, and the second diaphragm is provided with the second dielectric and the second electrode. The first and second dielectrics may be formed from one or more dielectric materials, respectively, and may have different or the same thickness, tension and material composition. Two or more dielectrics may be stacked to form a laminate. The first and second electrodes may be respectively constructed on surfaces of the first dielectric and second dielectric by any one of evaporation deposition, sputtering deposition and coating. The third electrode is disposed between the first electrode and the second electrode. For joining, a third binder is coated between the first electrode and the third electrode, and between the second electrode and the third electrode. The third binder may be conductive or non-conductive paste. In the case of using conductive paste, in addition to electrical conductance, an excellent adherence between the first electrode and the second electrode, and between the first electrode and the third electrode is important. Also, depending on using conductive or non-conductive paste as the third binder, the operating manner of the first and second diaphragms may vary. Moreover, for better adherence, the first and second binders are selected depend on the materials used for the first driving element, the second driving element, the first spacer, the second spacer, the first dielectric, and the second dielectric. An alternating voltage provides potentials to the first driving element and second driving element through a transformer and a coil by connecting to a bias voltage. One end of the bias voltage is connected to the first electrode and third electrode or to the second electrode and third electrode, while the other end thereof is connected to the coil providing potentials to the first and second driving elements. In the case that the alternating voltage provides a negative potential to the first driving element and a positive potential to the second driving element, and a bias is applied to the second electrode and third electrode so that both have positive potentials, when using conductive paste as the third binders, charges are transmitted from the third electrode to the first and second electrodes via the conductive paste, and thus the first and second electrodes have positive polarity. Inductive charges are created in the first and second dielectrics due to the positive charges of the first and second electrodes. Accordingly, polarization effect is shown, and one end of the first dielectric close to the first driving element is polarized to have positive charges, which is in turn attracted by the first driving element having negative charges. In a similar manner, one end of the second dielectric close to the second driving element is polarized to have positive charges, which is in turn repelled by the second driving element having positive charges. As such, the first dielectric drives the first diaphragm to vibrate toward the first driving element because of the attractive electrostatic correlation between the first dielectric and first driving element, while the second dielectric drives the second diaphragm to vibrate toward the first driving element because of the repellent electrostatic correlation between the second dielectric and second driving element, i.e. the first diaphragm and second diaphragm vibrate in the same direction. When another cycle is performed, the alternating voltage provides a positive potential to the first driving element and a negative potential to the second driving element, and the potentials of the third electrode and second electrode remain positive; alternatively, the potentials of the first and second driving elements stay unchanged, i.e., the first driving element has a negative potential and the second driving element has a positive potential, while the potentials of the third electrode and second electrode are switched to be negative. Thus, the first and second diaphragms would both vibrate toward the second driving element. By repetitively switching the positive and negative potentials, the first and second diaphragms would repetitively vibrate to create sounds. Since electrets are not used in the first and second dielectrics, a large diaphragm thickness is not required for storing electric charges, and this enables the thinning of products. Besides, by combining dielectrics of various tensions, the bandwidth of diaphragm vibration may be significantly enlarged, so the conventional defect of insufficient bandwidth can be addressed. Furthermore, by employing the dual-diaphragm effect produced by the first and second diaphragms, the electric field intensity between the diaphragms and the driving elements is increased, so the problems of prior art, which relate to poor efficiency and requirement of large area for improvement, can be solved.

The present invention provides an electrostatic electroacoustic transducer which may be an audio receiver. As the electrostatic electroacoustic transducer receives sounds, the first and second diaphragms vibrate due to the received sound pressures of various frequencies. Thus, potential differences occur in powered lines because of the changes in the distance between the first diaphragm and the first driving element, and between the second diaphragm and the second driving element. As a consequence, by amplifying the induced current through particular circuits, sufficient signals may be obtained for being retrieved into storage media (not shown). Besides, there is no directivity in the sound receiving, so sounds from various directions can be received.

The present invention provides an electrostatic electroacoustic transducer, in which electrets are not necessary for the first and second dielectrics. An electret is a dielectric material having a quasi-permanent polarization after being polarized. Many organic materials (e.g. paraffin wax, ebonite, hydrocarbon, solid acid, etc.) or inorganic materials (e.g. barium titanate, calcium titanate, etc.) may be used for preparing electrets. In the case that the diaphragm is an electret, static electricity on the diaphragm charges the surface of the diaphragm by corona discharging. However, there exists a delayed phenomenon in static electricity, the voltage of generally stable static electricity is about only 200-400 volts, because static electricity may easily leak if the voltage thereof is too high, and a thicker diaphragm would be required for storing charges. The present invention employs an external bias voltage, and is provided with a third electrode, so there are no issues of delayed phenomenon in the created static electricity and diaphragm thickness. The voltage of the created static electricity is about 500-3000 volts. As a result, the product according to the present invention can be thinned, and the efficiency and bandwidth thereof can be dramatically promoted as well.

The present invention provides an electrostatic electroacoustic transducer, in which the intensity of electric field between the diaphragms and the driving elements can be dramatically improved through a dual-diaphragm design. By using fundamental principles of Coulomb's law to significantly promote the efficiency of the electrostatic electroacoustic transducer of the present invention, the problem of expensiveness due to the requirement of diaphragms with large areas for addressing the insufficient efficiency of prior art can be solved. Also, by using different material strengths and tensions in the dual-diaphragm design to raise the frequency range of audio response, the conventional defect of insufficient bandwidth can be addressed. Further, the present invention is suitable for mass production since the acoustic transducer of the present invention may be fabricated using existing technologies without any problem. The product of the present invention can be thinned to be easily attached to surfaces of an object for playing and receiving sounds. As a result, the application range of the present invention can be enlarged, and this eliminates the defect of limited application for prior art. Because the area of the acoustic transducer of present invention is much smaller than that of conventional acoustic transducers, the present invention not only avoids problems of high cost and energy consuming that cause prior art to be uncompetitive in mass production, but also meets the market demand.

DETAILED DESCRIPTION OF THE PREFERRED EMBODIMENTS

Regarding an electrostatic electroacoustic transducer 1 of the present invention, the applications and principle of converting electric energy into acoustic energy thereof have been well understood by those with ordinary knowledge in the art. Therefore, in the following, description is only made in detail to explain the innovative functions of the assembled electrostatic electroacoustic transducer 1 of the present invention. In addition, the following drawings are not drawn to actual scale and are used only for illustrating representations associated to the features of the present invention.

Figure 1:
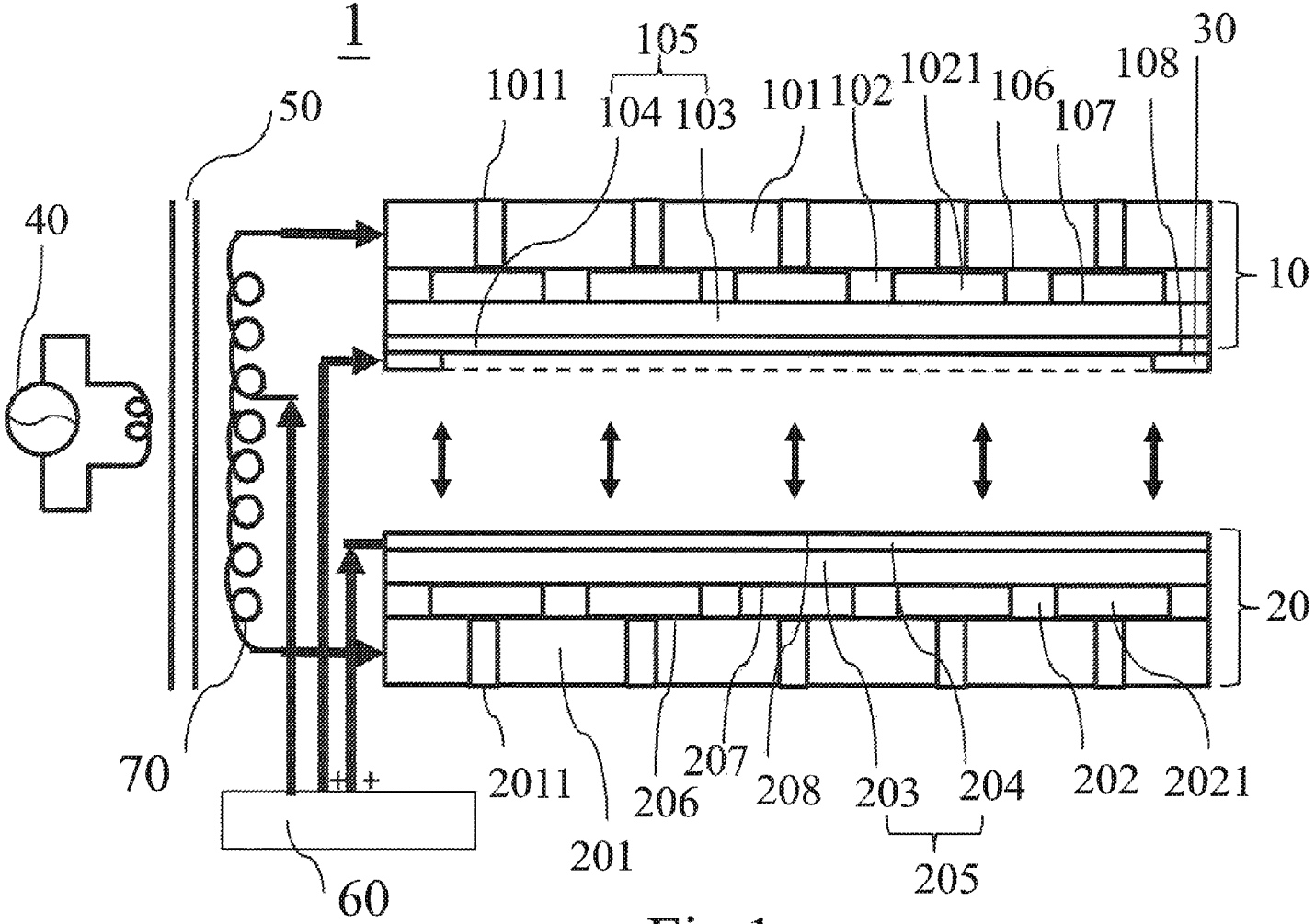
FIG. 1 is a cross-sectional schematic view showing connections of respective elements of an electrostatic electroacoustic transducer according to a first embodiment of the present invention.
Figure 2:
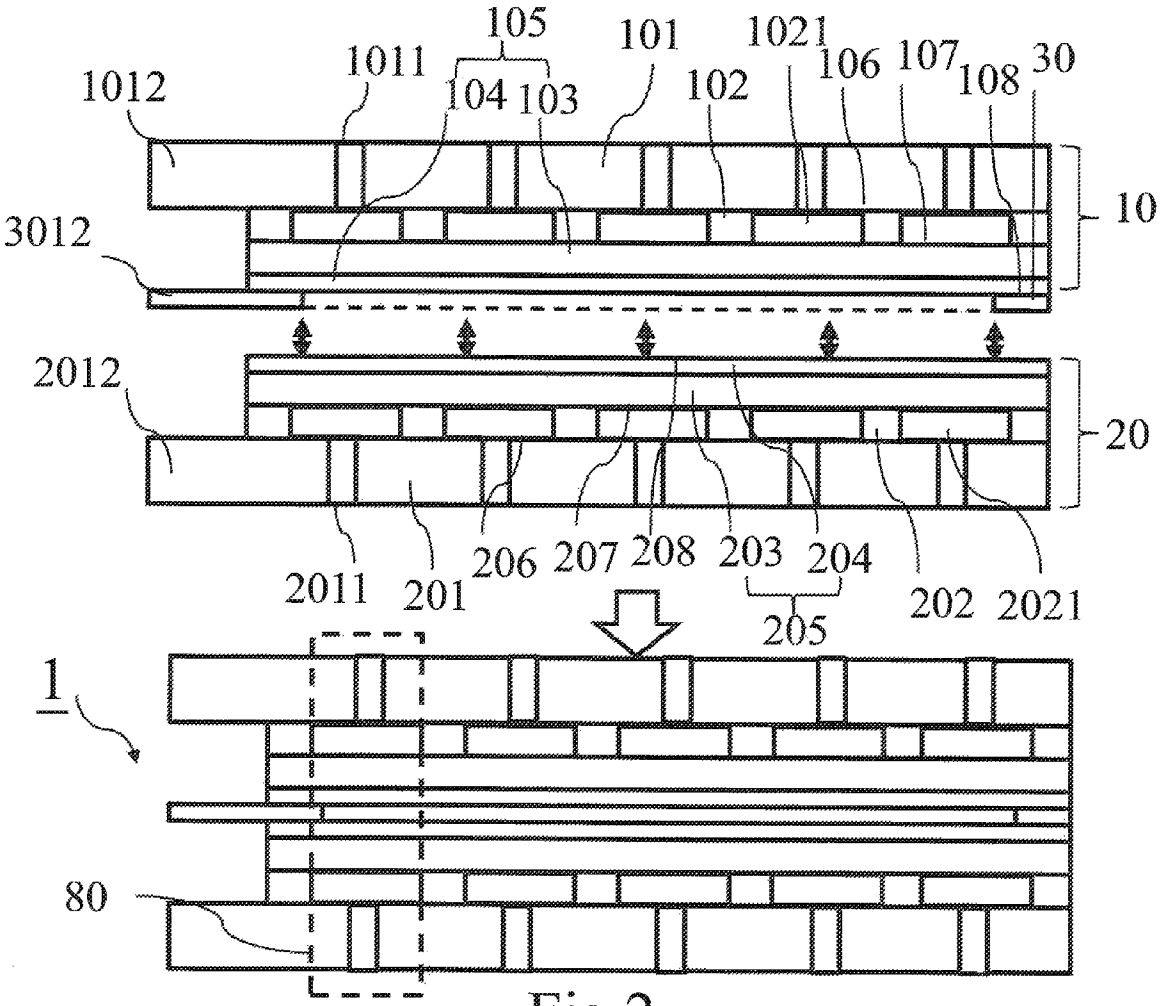
FIG. 2 is a cross-sectional schematic view showing the assembled electrostatic electroacoustic transducer according to the first embodiment of the present invention.

Please refer to FIG. 1, FIG. 2, FIG. 3 and FIGS. 4A-4C, the electrostatic electroacoustic transducer 1 according to a first embodiment of the present invention comprises a first structure 10, a second structure 20 and a third electrode 30, wherein the third electrode 30 is located between the first structure 10 and the second structure 20. The first structure 10 includes a first driving element 101, a first spacer 102 and a first diaphragm 105; the second structure 20 includes a second driving element 201, a second spacer 202 and a second diaphragm 205, wherein the first diaphragm 105 has a first dielectric 103 and a first electrode 104, and the second diaphragm 205 has a second dielectric 203 and a second electrode 204. When the first structure 10, the second structure 20 and the third electrode 30 are assembled into the electrostatic electroacoustic transducer 1 having a dual-diaphragm structure, as shown in FIG. 2, the first structure 10 and the second structure 20 show a mirror-inverted arrangement, in which the first driving element 101, the first spacer 102, the first dielectric 103, the first electrode 104, the third electrode 30, the second electrode 204, the second dielectric 203, the second spacer 202 and the second driving element 201 are sequentially arranged from top to bottom, wherein a first binder 106 is coated between the first driving element 101 and the first spacer 102, a second binder 107 is coated between the first spacer 102 and the first dielectric 103, and a third binder 108 is coated between the first electrode 104 and the third electrode 30. Similarly, a first binder 206 is coated between the second driving element 201 and the second spacer 202, a second binder 207 is coated between the second spacer 202 and the second dielectric 203, and a third binder 208 is coated between the second electrode 204 and the third electrode 30. Binder materials are selected depend upon the materials of the two objects to be joined, such that the effect of diaphragm motion caused by electrostatic forces will not be affected. Specifically, the third binders 108 and 208 may be conductive or non-conductive binders. In the assembled electrostatic electroacoustic transducer 1, the first driving element 101, the second driving element 201 and the third electrode 30 are respectively provided with a first connecting end 1012, a second connecting end 2012 and a third connecting end 3012 which are capable of being connected to an external bias voltage 60.

Continue referring to FIG. 1, the first driving element 101 and second driving element 201 are formed of porous conductive materials, such as conductive perforated metal plates, perforated metal meshes, conductive perforated polymer plates or other conductive perforated materials, or transparent conductive perforated plates formed by coating transparent materials with transparent conductive films (e.g. Indium Tin Oxide, ITO or other conductive materials). The first driving element 101 and second driving element 201 are provided with a plurality of first holes 1011 and a plurality of second holes 2011, respectively, serving as sound channels for the first diaphragm 105 and second diaphragm 205 producing vibrational motions, such that the sounds can be transmitted outwards, wherein the percentage of open area is preferably 20-70%. Moreover, the first driving element 101 and second driving element 201 may be selected from the group consisting of soft or hard porous conductive materials. In the case that the first driving element 101 and second driving element 201 are both soft materials characterized by flexibility, applications to flexible electrics or the like are possible.

Continue referring to FIG. 1, the first spacer 102 and second spacer 202 serve to support and separate the driving elements and the diaphragms, so as to prevent the electrostatic electroacoustic transducer 1 from being silent due to the electrostatic contact between the driving elements and the diaphragms. Further, the first spacer 102 and second spacer 202 are provided with a plurality of first intervals 1021 and a plurality of second intervals 2021, respectively, functioning as regions for the first diaphragm 105 and second diaphragm 205 producing vibrational motions, wherein the first intervals 1021 and second intervals 2021 may be triangular, cylindrical or quadrangular, and are preferably quadrangular, such as square or rectangular. The first diaphragm 105 is provided with the first dielectric 103 and the first electrode 104, and the second diaphragm 205 is provided with the second dielectric 203 and the second electrode 204. The first dielectric 103 and second dielectric 203 may be formed from a film of single dielectric or a laminate of one or more dielectric films, and may have different or the same thickness, tension and material. The dielectrics may be selected from films of synthetic polymers such as polyethyleneterephthalate (PET), polybutylene terephthalate (PBT), polypropylene (PP), polyimide (PI), polyetherimide (PEI), polyvinylbutyral (PVB), ethylvinylacetate copolymer (EVA), polyethylene 2,6-naphthalate (PEN), Nylon, polyphenylene sulfide (PPS), polyetheretherketone (PEEK), polytetrafluoethylene (PTFE), fluorinated ethylenepropylene copolymer (FEP), polyvinylidene fluoride (PVDF), polyvinyl fluoride (PVF), Ethylene Tetrafluoroethylene copolymer (ETFE), vinylidene fluoride/hexafluoropropylene copolymer (VDF/HFP), vinylidene fluoride/trifluoroethyene copolymer (VDF/TrFE), or modifications or improvements thereof. Two or more dielectrics may be stacked to form a laminate. Furthermore, the aforementioned dielectrics may be combined with other aliphatic or aromatic polymer films to form a laminate.

Figure 3:
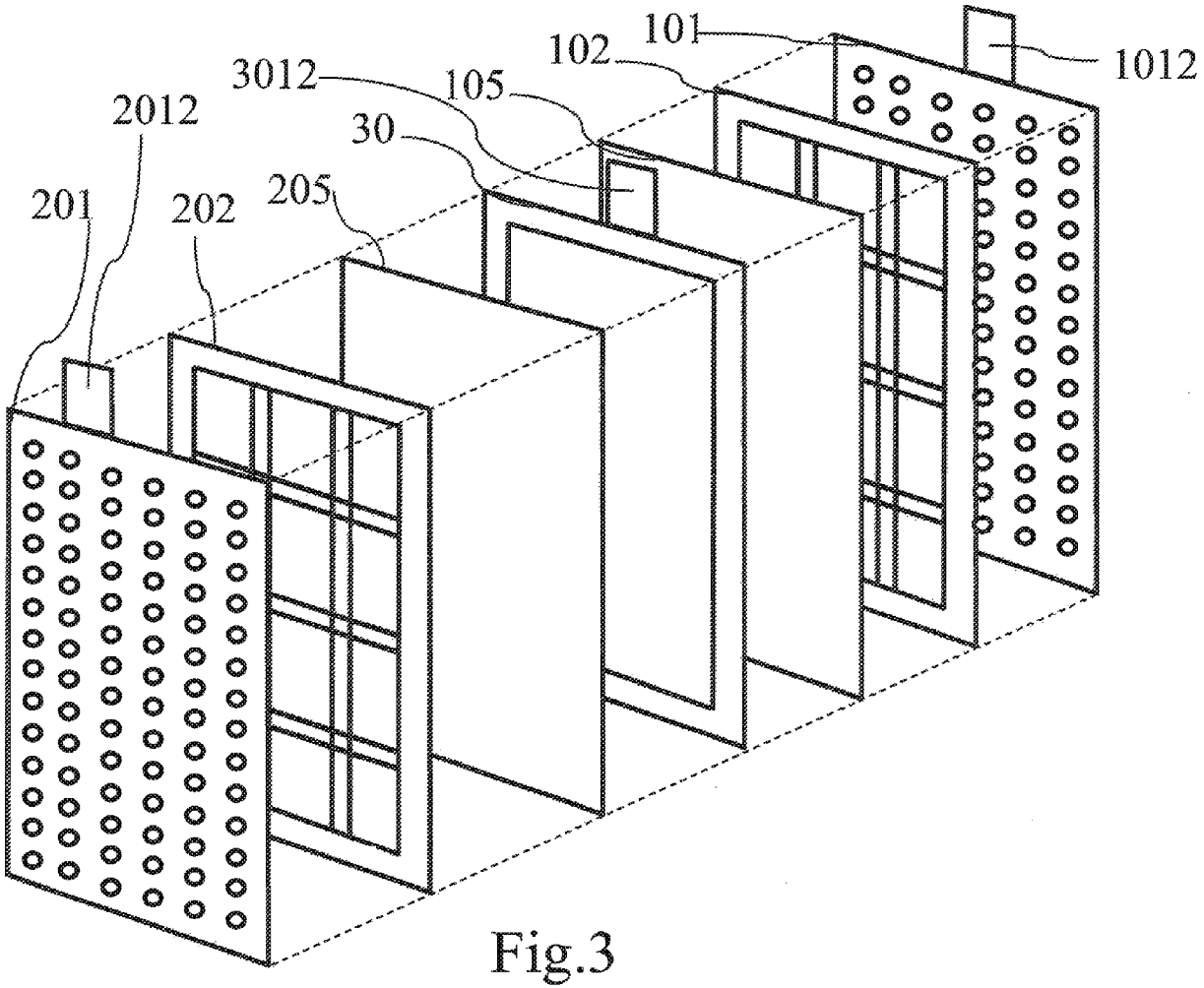
FIG. 3 is a perspective view showing the electrostatic electroacoustic transducer being assembled according to the first embodiment of the present invention.
Figure 4C:
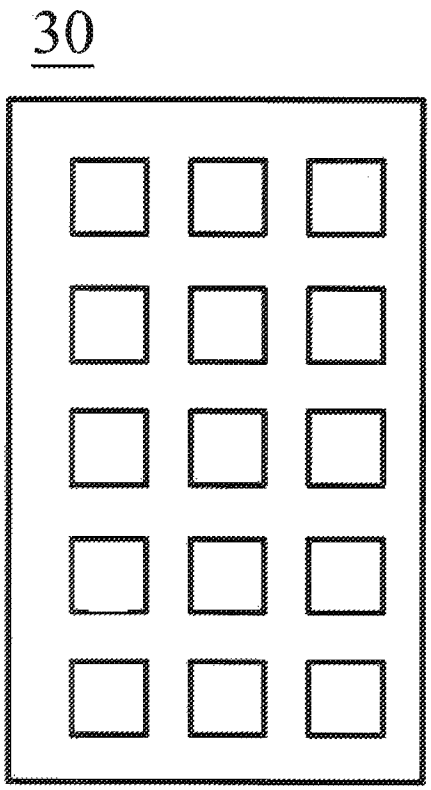
FIGS. 4A-4C are schematic views showing third electrodes of various shapes for the electrostatic electroacoustic transducer according to the first embodiment of the present invention.
Figure 4B:
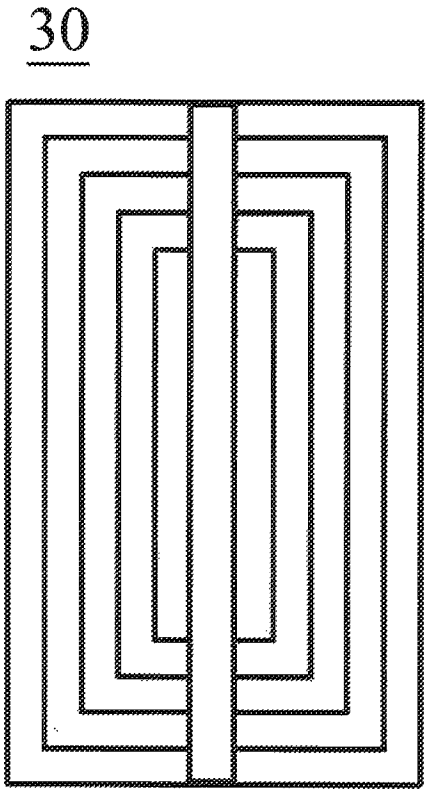
Figure 4A:
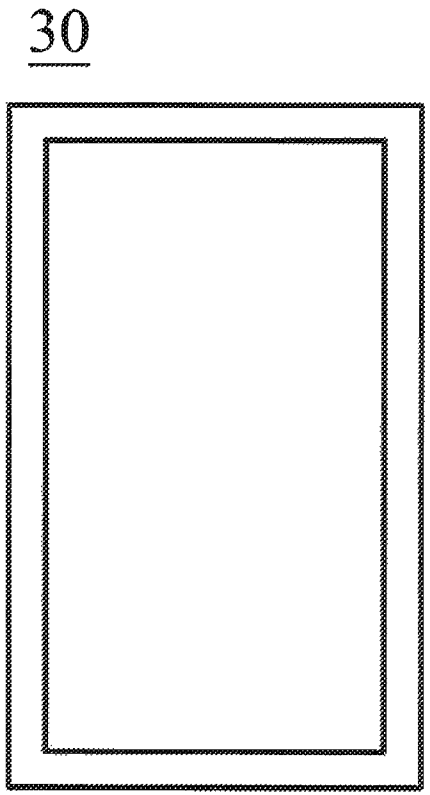

Continue referring to FIG. 3, the first electrode 104 and second electrode 204 may be respectively constructed on surfaces of the first dielectric 103 and second dielectric 203 by evaporation deposition, sputtering deposition or coating. Preferably, the thicknesses of the first electrode 104 and second electrode 204 range from 0.01 to 3 μm. The first electrode 104 and second electrode 204 may be formed of conductive materials such as conductive silver paste, Indium Tin Oxide (ITO), Indium Zinc Oxide (IZO), Aluminum Zinc Oxide (AZO), Carbon Nanotube (CNT), Graphite Powder, and conductive metals. The third electrode 30 is disposed between the first electrode 104 and the second electrode 204 and is a metal electrode. Preferably, the third electrode 30 is a copper plate. In addition, continue referring to FIGS. 4A to 4C, the third electrode 30 may be desirably shaped to further increase the contact area of the first electrode 104 and third electrode 30 or the second electrode 204 and third electrode 30, so that the conduction of electric charges or electric polarization can be more efficient. The shape of the third electrode 30 may be circular shape as shown in FIG. 4A, plural circular shape as shown in FIG. 4B or grid-like shape as shown in FIG. 4C. In a preferable embodiment, the third electrode 30 is a circular electrode. However, the third electrode 30 is not limited to the aforementioned three shapes, and may be any shape.

Please refer to FIG. 1, FIG. 2, FIGS. 5A and 5B for operations of the electrostatic electroacoustic transducer in a sounding region 80 according to the first embodiment of the present invention, wherein an alternating voltage 40 provides potentials to the first driving element 101 and second driving element 201 through a transformer 50 and a coil 70 by connecting to a bias voltage 60. The bias voltage 60 is preferably a direct current (DC) voltage. One end of the bias voltage 60 is connected to the first electrode 104 and third electrode 30 or to the second electrode 204 and third electrode 30, while the other end thereof is connected to the coil 70 providing potentials to the first driving element 101 and second driving element 201. In the case that the alternating voltage 40 provides a negative potential to the first driving element 101 and a positive potential to the second driving element 201, and the third binders 108, 208 are conductive paste, a bias is applied to the second electrode 204 and third electrode 30 so that both have positive potentials. Accordingly, the first electrode 104 has a positive potential, due to which the first dielectric 103 produces inductive charges and polarization effect is shown. As a result, one end of the first dielectric 103 close to the first driving element 101 has a positive potential, which is in turn attracted by the negative potential of the first driving element 101. On the other hand, the second dielectric 203 produces inductive charges due to the second electrode 204. As a result, one end of the second dielectric 203 close to the second driving element 201 has a positive potential, which is in turn repelled by the positive potential of the second driving element 201. As such, the first dielectric 103 drives the first diaphragm 105 to vibrate toward the first driving element 101 because of the attractive electrostatic correlation between the first dielectric 103 and first driving element 101, while the second dielectric 203 drives the second diaphragm 205 to vibrate toward the first driving element 101 because of the repellent electrostatic correlation between the second dielectric 203 and second driving element 201, i.e. the first diaphragm 105 and second diaphragm 205 vibrate in the same direction. When another cycle, in which the alternating voltage 40 provides a positive potential to the first driving element 101 and a negative potential to the second driving element 201, is performed, the potentials of the third electrode 30 and second electrode 204 remain positive. Thus, the first diaphragm 105 and second diaphragm 205 would both vibrate toward the second driving element 201. By repetitively switching the positive and negative potentials, the first diaphragm 105 and second diaphragm 205 would repetitively vibrate to create sounds.

Figures 5A, 5B:
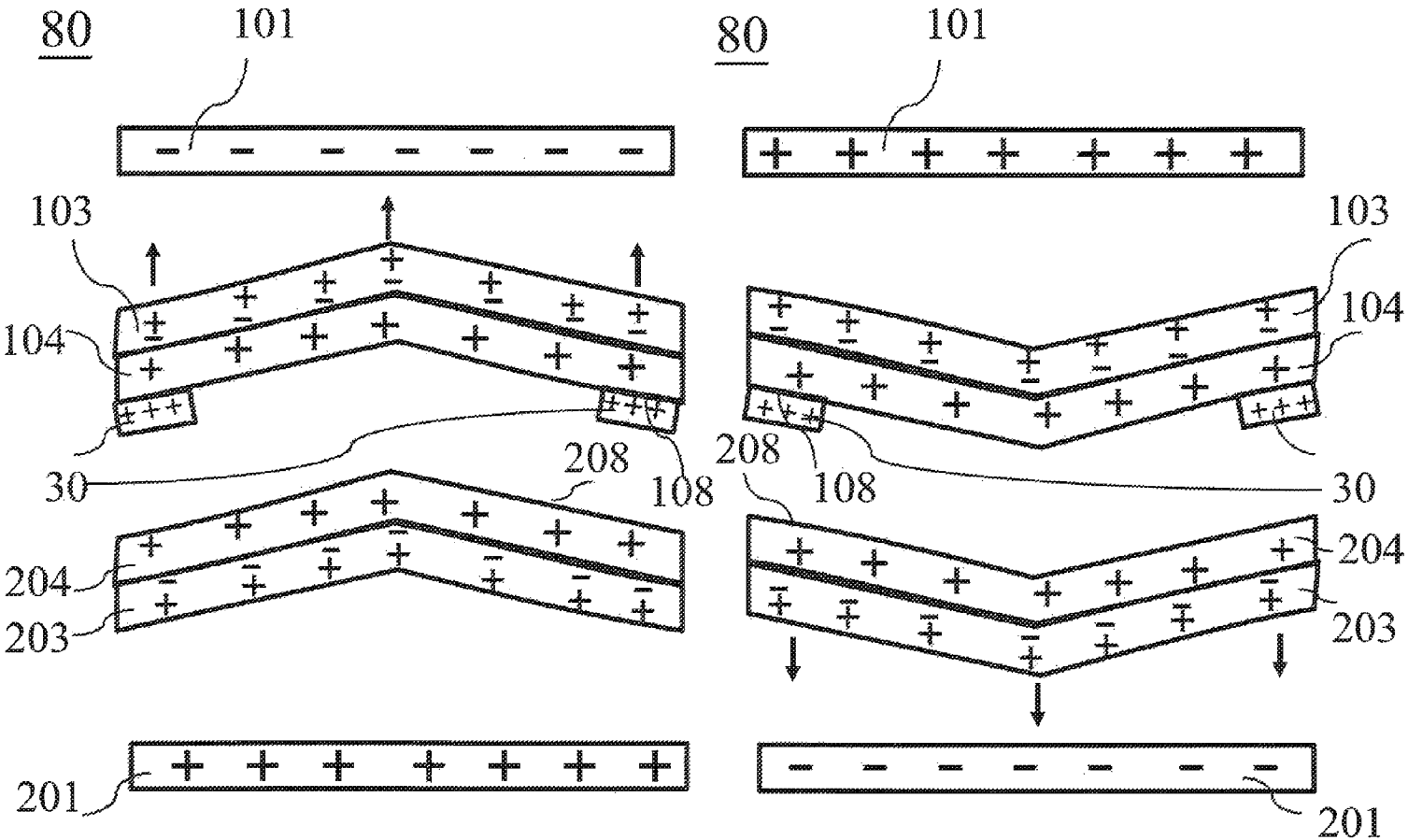
FIGS. 5A-5C are schematic views showing vibrations of a first diaphragm and a second diaphragm in a sounding region according to the first embodiment of the present invention.
Figure 5C:
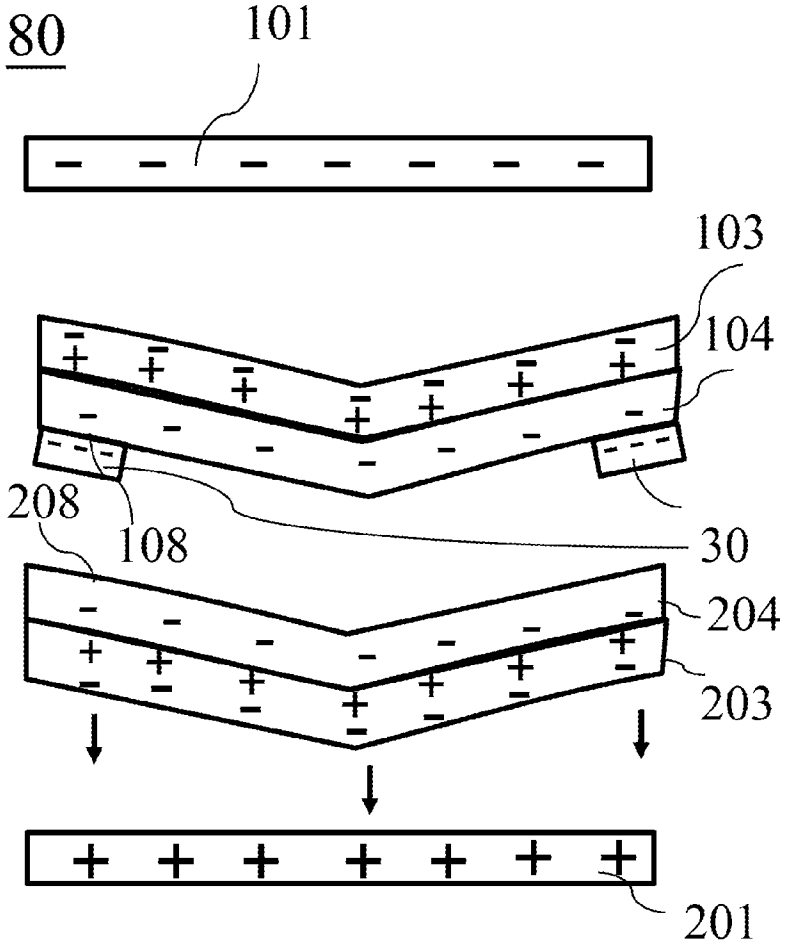
Figures 6A, 6B:
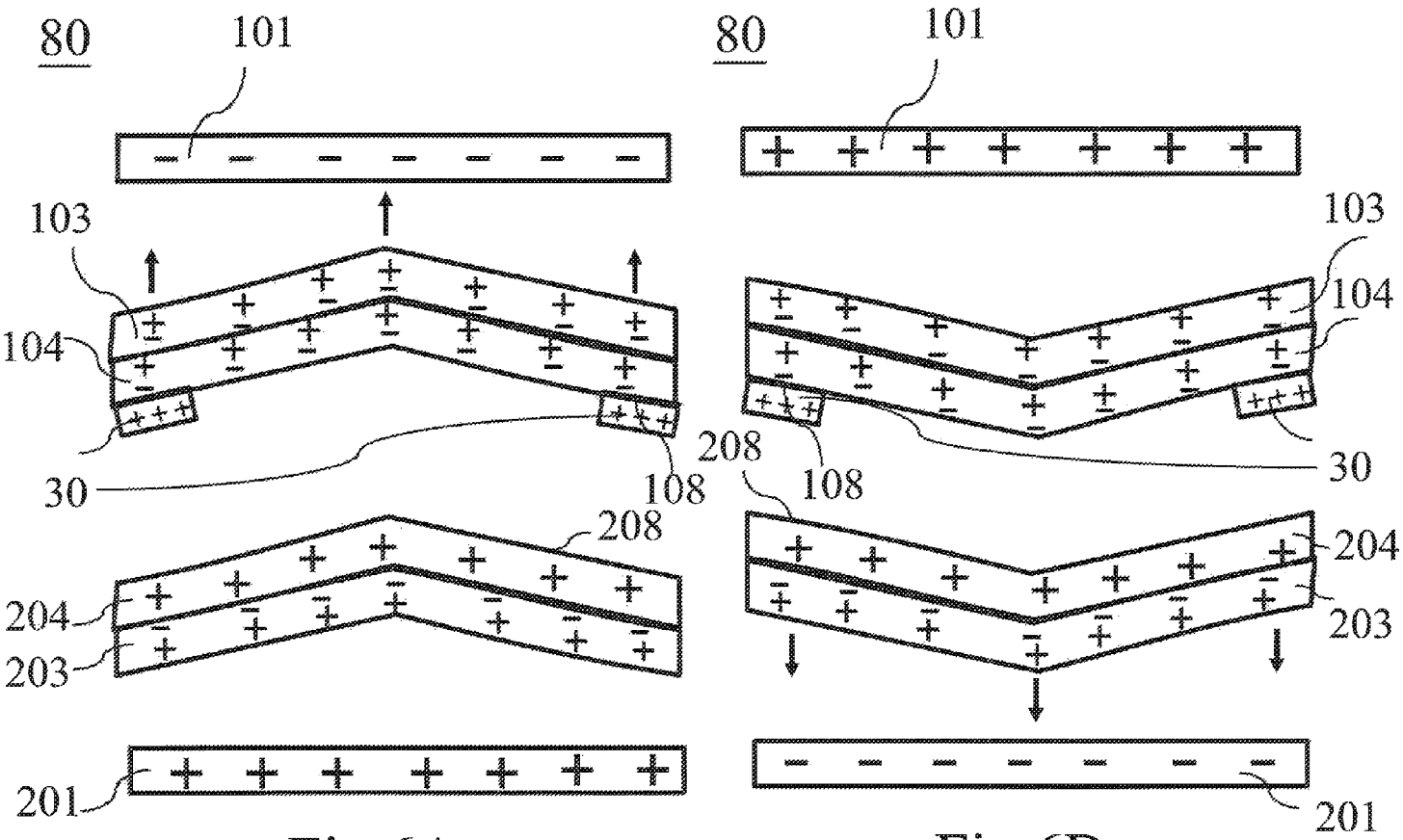
FIGS. 6A-6B are schematic views showing vibrations of the first diaphragm and the second diaphragm in the sounding region according to a second embodiment of the present invention.
Figures 7A, 7B:
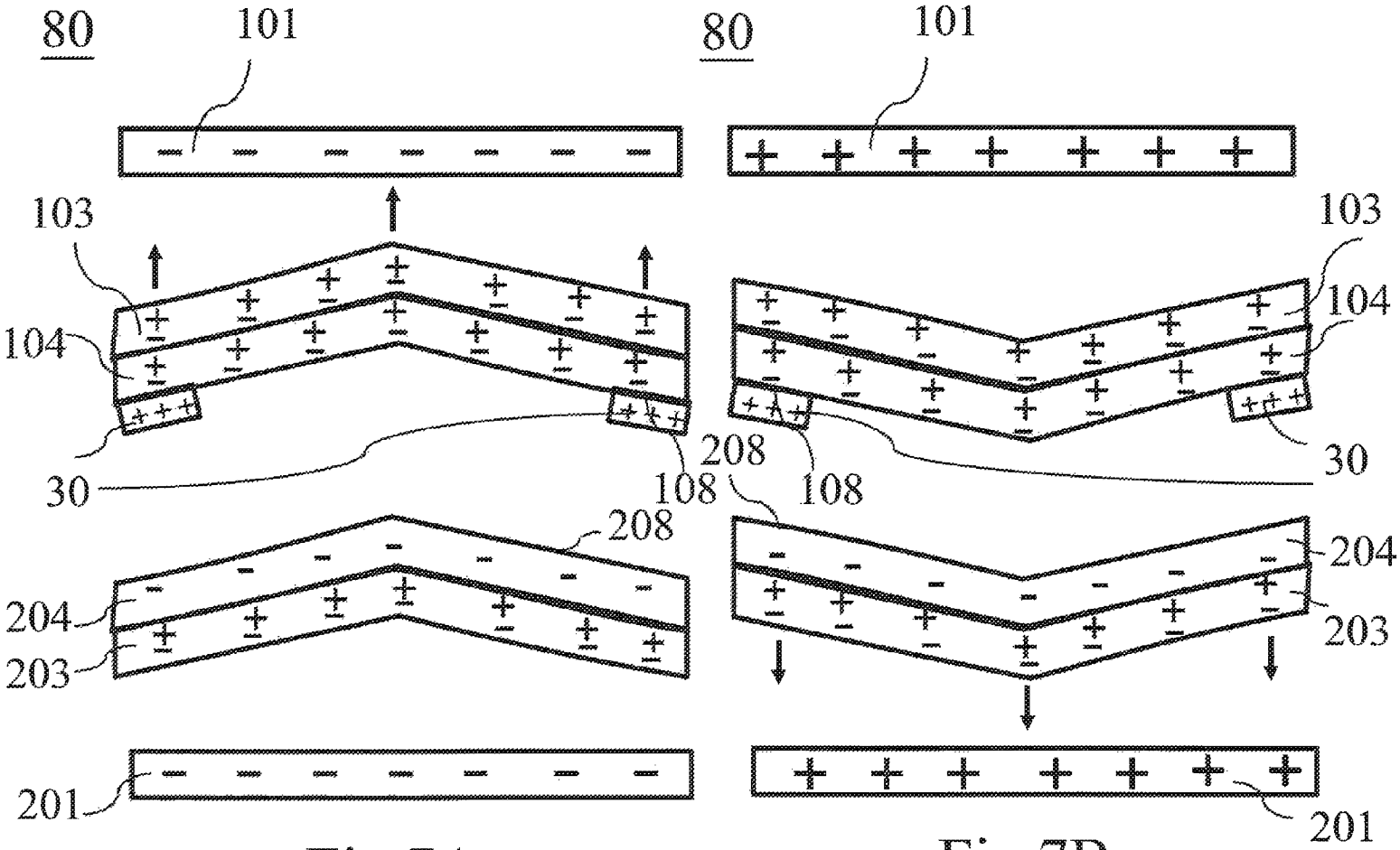
FIGS. 7A-7B are schematic views showing vibrations of the first diaphragm and the second diaphragm in the sounding region according to a third embodiment of the present invention.

Continue referring to FIGS. 5A and 5C, as another cycle begins in FIG. 5A, the potentials of the first driving element 101 and second driving element 201 stay unchanged. Specifically, the first driving element 101 has a negative potential and the second driving element 201 has a positive potential, while the potentials of the third electrode 30 and second electrode 204 are switched to be negative. As such, the first diaphragm 105 and second diaphragm 205 would both vibrate toward the second driving element 201. By repetitively switching the positive and negative potentials, the first diaphragm 105 and second diaphragm 205 would repetitively vibrate to create sounds.

Please refer to FIG. 1, FIG. 2, FIGS. 6A and 6B for operations of the electrostatic electroacoustic transducer in the sounding region 80 according to the second embodiment of the present invention. In the case that the alternating voltage 40 provides a negative potential to the first driving element 101 and a positive potential to the second driving element 201, and the third binders 108, 208 are non-conductive paste, a bias is applied to the second electrode 204 and third electrode 30 so that both have positive potentials. Accordingly, the first electrode 104 shows polarization effect due to the inductive charges of the third electrode 30. Due to the first electrode 104, the first dielectric 103 also produces inductive charges and shows polarization effect. As a result, one end of the first dielectric 103 close to the first driving element 101 has a positive potential, which is in turn attracted by the negative potential of the first driving element 101. On the other hand, the second dielectric 203 produces inductive charges due to the second electrode 204. As a result, one end of the second dielectric 203 close to the second driving element 201 has a positive potential, which is in turn repelled by the positive potential of the second driving element 201. As such, the first dielectric 103 drives the first diaphragm 105 to vibrate toward the first driving element 101 because of the attractive electrostatic correlation between the first dielectric 103 and first driving element 101, while the second dielectric 203 drives the second diaphragm 205 to vibrate toward the first driving element 101 because of the repellent electrostatic correlation between the second dielectric 203 and second driving element 201, i.e. the first diaphragm 105 and second diaphragm 205 vibrate in the same direction. When another cycle, in which the alternating voltage 40 provides a positive potential to the first driving element 101 and a negative potential to the second driving element 201, is performed, the potentials of the third electrode 30 and second electrode 204 remain positive. Thus, the first diaphragm 105 and second diaphragm 205 would both vibrate toward the second driving element 201. By repetitively switching the positive and negative potentials, the first diaphragm 105 and second diaphragm 205 would repetitively vibrate to create sounds.

Please refer to FIG. 1, FIG. 2, FIGS. 7A and 7B for operations of the electrostatic electroacoustic transducer in the sounding region 80 according to a third embodiment of the present invention. In the case that the alternating voltage 40 provides negative potentials to both of the first driving element 101 and second driving element 201, and the third binders 108, 208 are non-conductive paste, the bias voltage 60 is applied to the second electrode 204 and third electrode 30 so that the second electrode 204 has a negative potential and the third electrode 30 has a positive potential. Accordingly, the first electrode 104 shows polarization effect due to the inductive charges of the third electrode 30. Due to the first electrode 104, the first dielectric 103 also produces inductive charges and shows polarization effect. As a result, one end of the first dielectric 103 close to the first driving element 101 has a positive potential, which is in turn attracted by the negative potential of the first driving element 101. On the other hand, the second dielectric 203 produces inductive charges due to the second electrode 204. As a result, one end of the second dielectric 203 close to the second driving element 201 has a negative potential, which is in turn repelled by the negative potential of the second driving element 201. As such, the first dielectric 103 drives the first diaphragm 105 to vibrate toward the first driving element 101 because of the attractive electrostatic correlation between the first dielectric 103 and first driving element 101, while the second dielectric 203 drives the second diaphragm 205 to vibrate toward the first driving element 101 because of the repellent electrostatic correlation between the second dielectric 203 and second driving element 201, i.e. the first diaphragm 105 and second diaphragm 205 vibrate in the same direction. When another cycle is performed, the alternating voltage 40 provides positive potentials to the first driving element 101 and second driving element 201, while the potentials of the third electrode 30 and second electrode 204 remain negative. Alternatively, the potentials of the first driving element 101 and second driving element 201 remain negative, while the potential of the third electrode 30 is switched to be negative, with the potential of the second electrode 204 switched to be positive. Thus, the first diaphragm 105 and second diaphragm 205 would both vibrate toward the second driving element 201. By repetitively switching the positive and negative potentials, the first diaphragm 105 and second diaphragm 205 would repetitively vibrate to create sounds.

Figure 8:
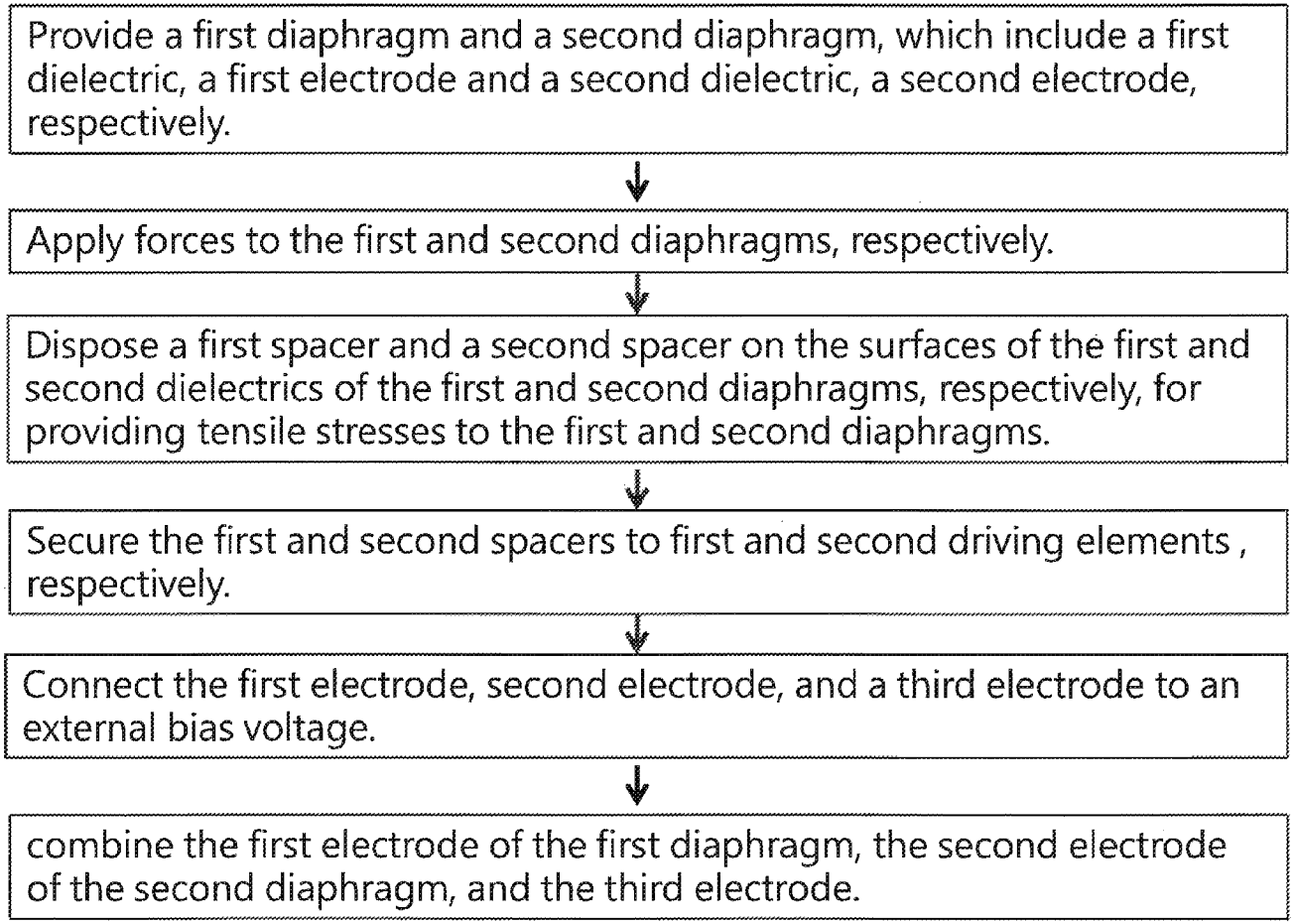
FIG. 8 is a schematic view showing the fabricating method for the electrostatic electroacoustic transducer according to the first embodiment of the present invention.

Please refer to FIG. 8, a method for fabricating the electrostatic electroacoustic transducer 1 according to the first embodiment of the present invention comprises several steps. First, provide the first diaphragm 105 and second diaphragm 205, wherein the first diaphragm includes the first dielectric 103 and the first electrode 104, and the second diaphragm 205 includes the second dielectric 203 and the second electrode 204. Next, apply tensions respectively to the first diaphragm 105 and second diaphragm 205. Then, dispose the first spacer 102 and second spacer 202 respectively on the surfaces of the first dielectric 103 and second dielectric 203, so as to provide tensile stresses to the first diaphragm 105 and second diaphragm 205. Next, secure the first spacer 102 and second spacer 202 to the first driving element 101 and second driving element 201. Next, connect the first electrode 104, second electrode 204 and third electrode 30 to the external bias voltage 60. Then combine the first electrode 104 of the first diaphragm 105, the second electrode 204 of the second diaphragm 205 and the third electrode 30.

The electrostatic electroacoustic transducer 1 according to the first embodiment of the present invention may be an audio receiver. As the electrostatic electroacoustic transducer 1 receives sounds, the first diaphragm 105 and second diaphragm 205 vibrate due to the received sound pressures of various frequencies. Thus, potential differences occur in powered lines because of the changes in the distance between the first diaphragm 105 and the first driving element 101, and between the second diaphragm 205 and the second driving element 201. As a consequence, by amplifying the induced current through particular circuits, sufficient signals may be obtained for being retrieved into storage media (not shown). Besides, there is no directivity in the sound receiving, so sounds from various directions can be received.

Although the present invention has been disclosed with the abovementioned preferred embodiments, these embodiments are not intended to limit the present invention. Alterations and modifications may be made by those skilled in the art without departing from the spirit and scope of the present invention. Therefore, the true scope of the present invention shall be defined by the appended claims.

What is claimed is:

1. An electrostatic electroacoustic transducer, consisting of:

a first structure having a first diaphragm, a first spacer and a first driving element arranged sequentially, the first diaphragm having a first non-electret dielectric and a first electrode, the first spacer separating the first diaphragm from the first driving element and securing the first diaphragm for providing a diaphragm tensile stress during the vibration of the first diaphragm;

a second structure having a second diaphragm, a second spacer and a second driving element arranged sequentially, the second diaphragm having a second non-electret dielectric and a second electrode, the second spacer separating the second diaphragm from the second driving element and securing the second diaphragm for providing a diaphragm tensile stress during the vibration of the second diaphragm, the second structure configured to be parallel to the first structure and coupled thereto, so that the first electrode and the second electrode face each other;

a binder provided at least on the surface of one of the first electrode and the second electrode, and configured to combine the first diaphragm and the second diaphragm; and a third electrode provided between the first structure and the second structure, wherein the first driving element and the second driving element are conductive material with a plurality of holes distributed thereon, and either the first or second electrodes and the third electrode are coupled to a direct current (DC) voltage, the first and second diaphragms are driven to deform in the same direction by inputting a voltage signal to the first and second driving elements for producing sounds.

2. The electrostatic electroacoustic transducer of claim 1, wherein the first driving element or the second driving element is a plate-like object selected from the group consisting of conductive metal plates, conductive metal meshes and conductive polymer thin plates.

3. The electrostatic electroacoustic transducer of claim 1, wherein the first driving element or the second driving element is a transparent substrate having a surface coated with a transparent conductive film.

4. The electrostatic electroacoustic transducer of claim 1, wherein a percentage of open area of the first driving element or the second driving element ranges 20-70%.

5. The electrostatic electroacoustic transducer of claim 1, wherein the first electrode or the second electrode is formed of any one conductive material selected from the group consisting of metal films, carbon nanotube, graphite powder, conductive silver past and indium tin oxide films.

6. The electrostatic electroacoustic transducer of claim 5, wherein the thickness of the first electrode or the second electrode ranges from 0.01 um to 3 um.

7. The electrostatic electroacoustic transducer of claim 1, wherein the electrostatic electroacoustic transducer is an acoustic receiver.

8. The electrostatic electroacoustic transducer of claim 1, wherein the first non-electret dielectric or the second non-electret dielectric is a film having any one synthetic polymer selected from the group consisting of PET, PI, PEN, PPS, PEI, PEEK, PTFE, FEP, PVDF, PVF, ETFE, VDF/HFP and VDF/TrFE.

9. The electrostatic electroacoustic transducer of claim 1, wherein the first non-electret dielectric or the second non-electret dielectric is a film having any two synthetic polymers selected from the group consisting of PET, PI, PEN, PPS, PEI, PEEK, PTFE, FEP, PVDF, PVF, ETFE, VDF/HFP and VDE/TrFE.

10. The electrostatic electroacoustic transducer of claim 1, wherein the third electrode is a circular electrode.

* * * * *